US005974930A

United States Patent [19]

Longrod

[11] Patent Number: 5,974,930

[45] Date of Patent: Nov. 2, 1999

[54] MINIATURE CUTTING APPARATUS FOR RECEIPT PRINTER

[75] Inventor: Scott Longrod, Lansing, N.Y.

[73] Assignee: Axiohm Transaction Solutions, Inc., Blue Bell, Pa.

[21] Appl. No.: 09/003,434

[22] Filed: Jan. 6, 1998

[51] Int. Cl.[6] ..... B26D 5/08

[52] U.S. Cl. ..... 83/629; 235/31 R; 902/36

[58] Field of Search ..... 235/31 R, 31 T; 902/18, 38; 83/629, 636

[56] References Cited

U.S. PATENT DOCUMENTS 4,917,514 4/1990 Richardson et al. ..... 400/120
4,936,177 6/1990 Ozawa et al. ..... 83/628
5,197,366 3/1993 Paulson et al. ..... 83/498
5,422,467 6/1995 Graef et al. ..... 235/379
5,564,593 10/1996 East, Sr. ..... 221/3
5,749,277 5/1998 Walker ..... 83/563

*Primary Examiner*—Donald Hajec
*Assistant Examiner*—Diane I. Lee
*Attorney, Agent, or Firm*—Salzman & Levy

[57] ABSTRACT

A new, miniaturized guillotine blade cutting mechanism is for cutting the paper web of the supply roll of a receipt printer. The miniaturized cutting mechanism features a direct drive mechanism and home switch which are both integral with the cutting blade holder.

9 Claims, 3 Drawing Sheets

MINIATURE CUTTING APPARATUS FOR RECEIPT PRINTER

FIELD OF THE INVENTION

The present invention relates to cutting apparatuses for printers and, more particularly, to a miniaturized guillotine knife mechanism for cutting the paper receipt of a receipt printer.

BACKGROUND OF THE INVENTION

Receipt printing mechanisms are ubiquitously found in many everyday machines, such as ATMs, gas pumps, food store check-out registers, retail establishment registers, etc. In many of these machines, the housing and associated drive mechanism for actuating the cutting blade to sever the receipts is quite large with respect to the blade itself. In addition, the housing and drive mechanism for the cutting blade is also particularly large with respect to the printing mechanism, which has become quite small with the advancements in this technology.

It would be desirable to miniaturize the cutting blade drive mechanism and housing in order to provide a receipt printer that is small and compact.

The present inventor has developed a new, miniaturized cutting blade mechanism and housing that is only approximately 60 millimeters in width. In fact, the housing of this miniature cutting mechanism is only slightly bigger than its guillotine knife cutting blade itself.

The blade is assembled within the housing, which comprises a small, low profile stepper motor. The stepper motor drives a rack and pinion mechanism, of which the rack is integral with the blade holder. That is, the rack is cut into the mid-section of the blade holder in order to reduce the height of the cutting mechanism. This rack arrangement also provides a direct drive for the cutting blade. The home switch for the cutting blade is also integrally disposed upon the cutting blade holder. This has the advantage of eliminating the need for assembly adjustments that were so common with prior art cutting mechanisms of this type. The stepper motor is very precise; it can be driven at a reduced stepper rate at the end of the cutting cycle. The reduced stepper rate is necessary in order to provide the required force to punch, rather than shear, the last six millimeters of the receipt that contacts the notch in the guillotine blade.

SUMMARY OF THE INVENTION

In accordance with the present invention, there is provided a miniaturized cutting mechanism for a receipt printer. The cutting mechanism and its associated housing is only approximately 60 millimeters in width. The guillotine blade of the cutting mechanism is assembled within the housing, which comprises a small, low profile stepper motor. The stepper motor drives a rack and pinion mechanism, of which the rack is integral with the blade holder. The rack is cut into the mid-section of the blade holder in order to reduce the height of the cutting mechanism. The rack and pinion arrangement also provides a direct drive for the blade. The pinion of the rack and pinion mechanism also comprises a dejamming slot, which is accessible through an aperture in the top of the cutting mechanism housing, thus providing easy access for correcting jamming problems. The home switch for the cutting blade is also integrally disposed upon the cutting blade holder. This has the advantage of eliminating the need for assembly adjustments. The stepper motor is very precise, and drivable at a reduced stepper rate at the end of the cutting cycle. The reduced stepper rate is necessary in order to provide the required force to punch, rather than shear, the last six millimeters of the receipt that contacts the notch in the guillotine blade.

It is an object of this invention to provide a new, miniaturized cutting mechanism for a receipt printer.

It is another object of the invention to provide a miniaturized cutting mechanism for a receipt printer that requires minimal assembly and is less costly to manufacture than are larger assemblies of the prior art.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components bear the same numbering and designations throughout the figures.

DESCRIPTION OF THE PREFERRED EMBODIMENT

Generally speaking, the invention features a new, miniaturized, guillotine blade, cutting mechanism for cutting the paper web of the supply roll of a receipt printer. The miniaturized cutting mechanism features a direct drive mechanism and home switch which are both integral with the cutting blade holder.

Figure 1:
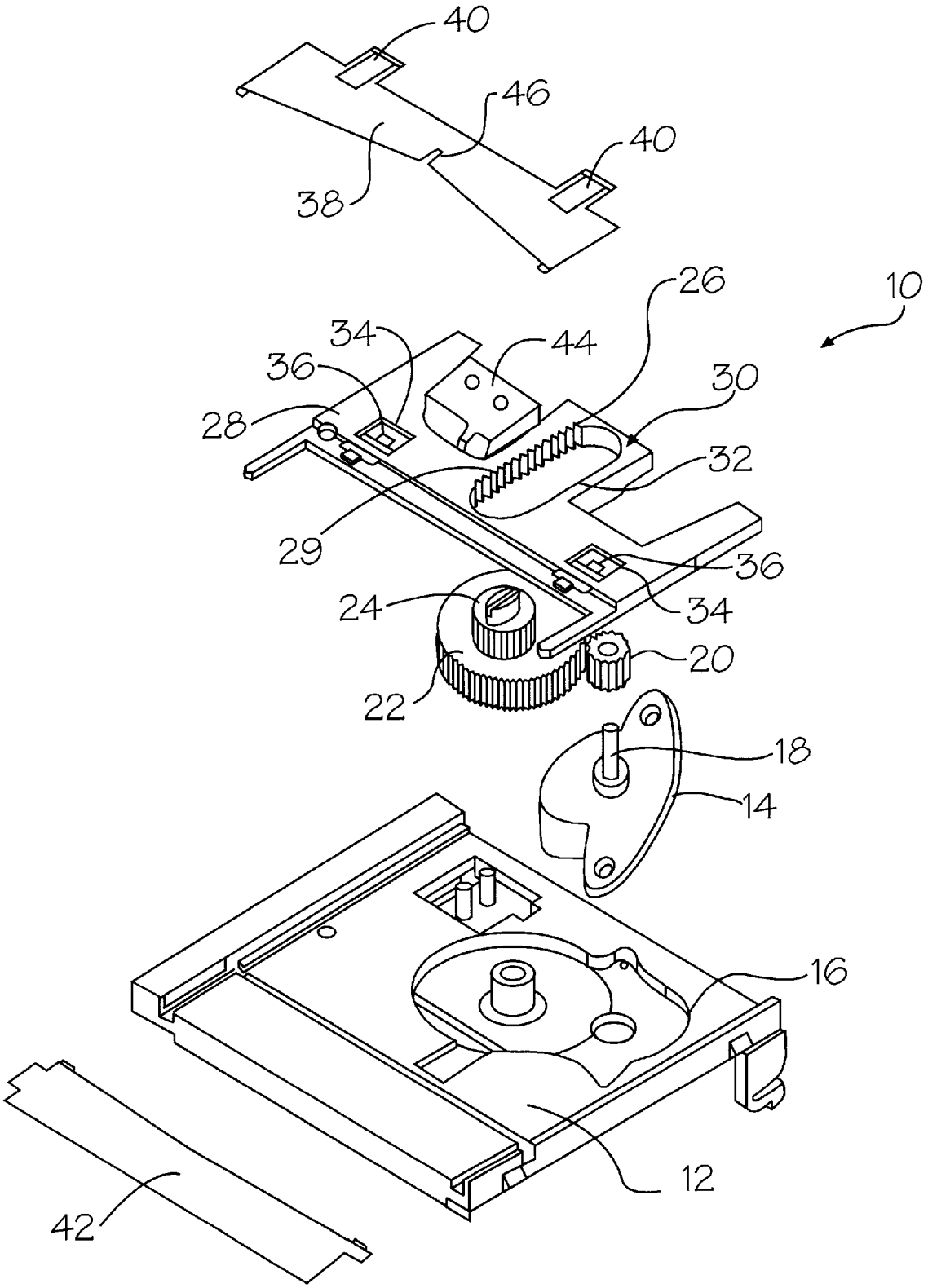
FIG. 1 illustrates a perspective, exploded view of the cutting blade mechanism of this invention.
Figure 2:
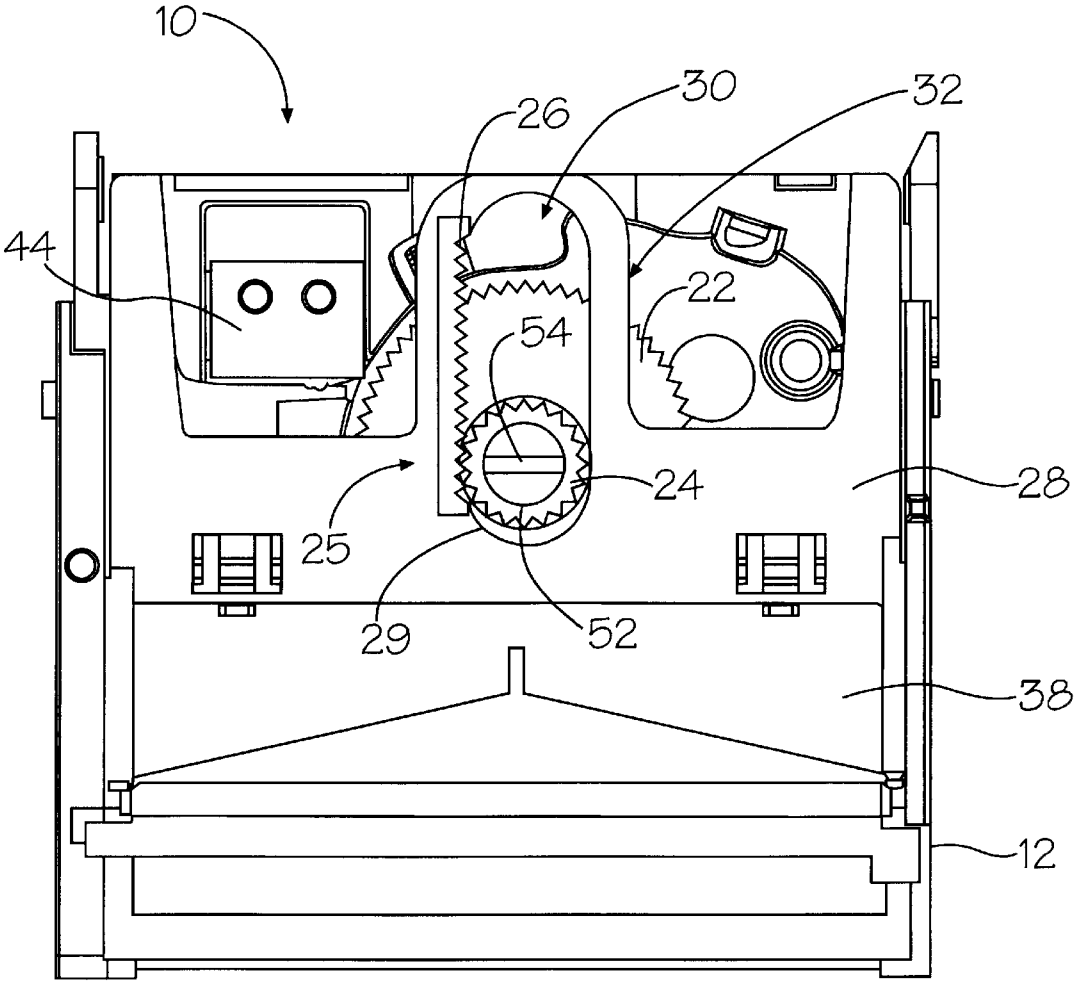
FIG. 2 depicts a top view of the cutting blade mechanism, shown in FIG. 1.

Now referring to FIGS. 1 and 2, the cutting blade mechanism 10 of this invention is illustrated. The cutting blade mechanism 10 comprises a knife assembly base 12 that supports a stepper motor 14 within a curvilinear cut-out section 16. A spur gear 20 is affixed to the shaft 18 of the stepper motor 14, and rotates therewith. In rotative engagement with spur gear 20 is a larger spur gear 22. Affixed to the center of spur gear 22 is a blade drive pinion gear 24 of a rack and pinion assembly, shown generally as reference numeral 25 of FIG. 2. The rack 26 of the rack and pinion assembly 25 is an integral part of the blade holder 28, and is formed within the left hand surface 29 of the elongated slot 30. A flat, right hand surface 32 of the elongated slot 30, acts as a guide and abutting surface for the pinion gear 24, thus ensuring its proper meshing with the rack 26.

The blade holder 28 has two blade affixing wells 34, which capture a guillotine blade 38. The wells 34 each have a resilient tab 36 that snaps into the respective retainer windows 40 of the blade 38, thereby capturing the blade 38.

A home switch 44 is molded into the blade holder 28. The molding of the home switch 44 integrates the switch with the moving blade assembly, so that the need for assembly adjustments is eliminated.

In operation, a stationary blade 42, bowed upwardly in the center thereof, receives the moving guillotine blade 38. Compression springs (not shown) may also be used to force the center portion of the blade 42 upwardly, to maintain tension for proper paper cutting. The paper (not shown)

trapped between these components 38, 42, which are in tension (much as the blades of a pair of scissors), is caused to be sheared, with the exception of the last six millimeters, which is punched out by the notch 46 in blade 38.

The stepper motor 14 is very precise, and can be driven at a reduced stepper rate at the end of the cutting cycle. The motor 14 is a ϕ25, 7.5° step motor, Model No. PM25S-048, manufactured by NMB, with a 0.4 module, 14T pinion. The reduced stepper rate is necessary in order to provide the required force to punch, rather than shear, the last six millimeters of the receipt.

Figure 3:
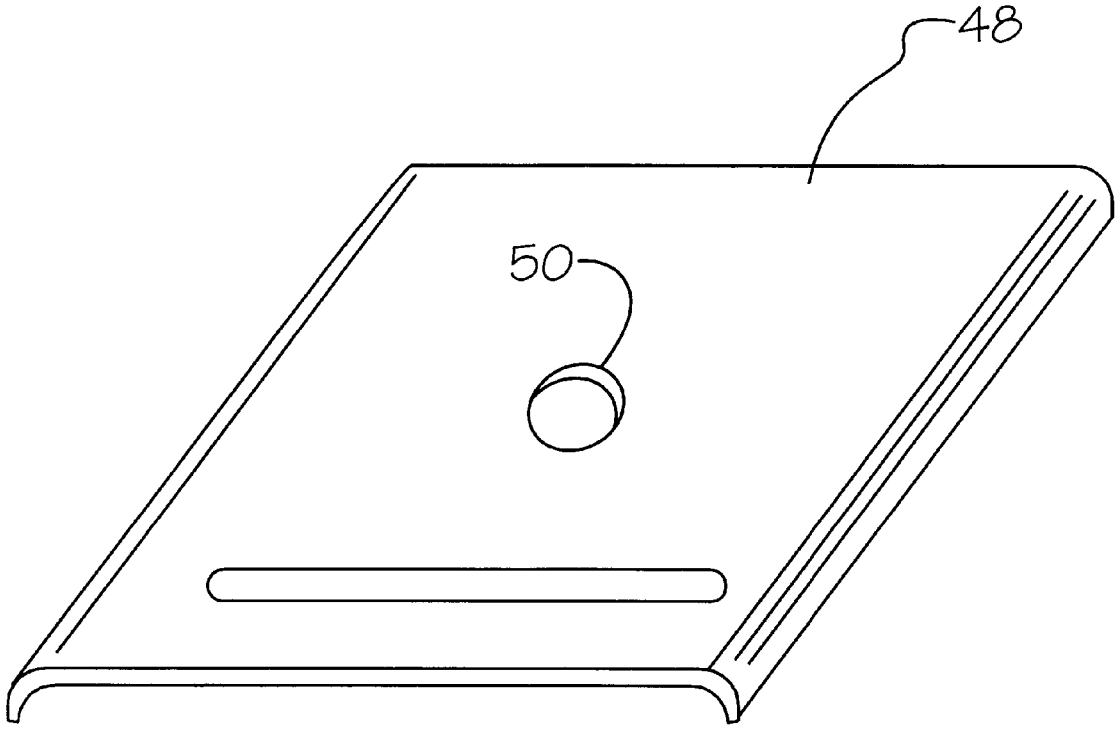
FIG. 3 shows a perspective exploded view of the cover plate of the mechanism shown in FIGS. 1 and 2, and its aperture for easily accessing the dejambing slot of the pinion gear that projects through the aperture.
Figure 3:
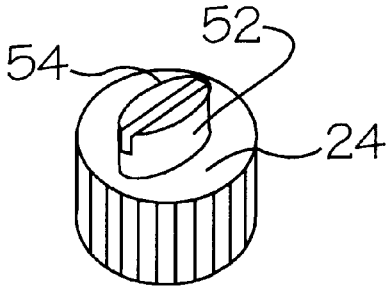

Referring to FIG. 3, the cover plate 48 of the cutting mechanism 10, illustrated in FIGS. 1 and 2, is shown having a circular aperture 50. The pinion gear 24 comprises a high hat 52 that projects through the circular aperture 50 when the mechanism 10 is assembled. The high hat 52 comprises a slot 54 that receives a coin or blade of a screw driver. A screw driver inserted into slot 54 and turned, can thus turn the pinion gear 24 from outside the housing, thus freeing up any jam that may occur during the paper cutting procedure.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A miniaturized cutting blade mechanism for a receipt printer, comprising:

a cutting blade;

a holder for said cutting blade, said holder comprising means defining an elongated slot, said elongated slot having an edge with a rack integrally formed therein;

a pinion gear for driving said rack and said holder of said cutting blade; and a stepper motor operatively connected to said pinion gear for rotating said pinion gear, and hence moving said cutting blade via said rack.

2. The miniaturized cutting blade mechanism for a receipt printer in accordance with claim 1, wherein said cutting blade comprises a guillotine blade.

3. The miniaturized cutting blade mechanism for a receipt printer in accordance with claim 1, further comprising a home switch that is integral with said holder.

4. The miniaturized cutting blade mechanism for a receipt printer in accordance with claim 1, further comprising a cover plate for said mechanism, said cover plate having an aperture through which said pinion gear can be accessed to free any jam that occurs during the cutting of a receipt by said mechanism.

5. The miniaturized cutting blade mechanism for a receipt printer in accordance with claim 1, wherein said elongated slot has an edge defining a guide for said pinion gear.

6. A miniaturized cutting blade mechanism for a receipt printer, comprising:

a cutting blade;

a holder for said cutting blade, said holder comprising means defining an elongated slot, said elongated slot having a first edge, and a second edge, said first edge having a rack integrally formed therein, and said second edge acting as a guide member for a pinion gear;

a pinion gear for driving said rack and said holder of said cutting blade; and a stepper motor operatively connected to said pinion gear for rotating said pinion gear, and hence moving said cutting blade via said rack.

7. The miniaturized cutting blade mechanism for a receipt printer in accordance with claim 6, wherein said cutting blade comprises a guillotine blade.

8. The miniaturized cutting blade mechanism for a receipt printer in accordance with claim 6, further comprising a home switch that is integral with said holder.

9. The miniaturized cutting blade mechanism for a receipt printer in accordance with claim 6, further comprising a cover plate for said mechanism, said cover plate having an aperture through which said pinion gear can be accessed to free any jam that occurs during the cutting of a receipt by said mechanism.

* * * * *